US010580298B1

(12) United States Patent
Amacker

(10) Patent No.: US 10,580,298 B1
(45) Date of Patent: Mar. 3, 2020

(54) SELF-DRIVING INFRASTRUCTURE

(71) Applicant: Toyota Research Institute, Inc., Los Altos, CA (US)

(72) Inventor: Matthew Amacker, Santa Clara, CA (US)

(73) Assignee: TOYOTA RESEARCH INSTITUTE, INC., Los Altos, CA (US)

( * ) Notice: Subject to any disclaimer, the term of this patent is extended or adjusted under 35 U.S.C. 154(b) by 0 days.

(21) Appl. No.: 16/128,332

(22) Filed: Sep. 11, 2018

(51) Int. Cl.
*G08G 1/0967* (2006.01)

(52) U.S. Cl.
CPC ..... *G08G 1/096791* (2013.01)

(58) Field of Classification Search
None
See application file for complete search history.

(56) References Cited

U.S. PATENT DOCUMENTS 7,979,172 B2 7/2011 Breed
8,547,250 B1 10/2013 Al-Mutawa
9,020,657 B2 * 4/2015 Uhler ..... H04W 4/021 701/1
2006/0055525 A1 * 3/2006 Kubota ..... G08G 1/0962 340/461
2008/0140318 A1 * 6/2008 Breed ..... B60N 2/2863 702/3
2009/0119014 A1 * 5/2009 Caplan ..... G01C 21/26 701/469
2015/0123816 A1 * 5/2015 Breed ..... G08G 1/162 340/905
2015/0339921 A1 * 11/2015 Hainzlmaier .... G08G 1/096811 340/905
2015/0346718 A1 12/2015 Stenneth
2016/0133130 A1 * 5/2016 Grimm ..... H04L 67/22 340/905
2017/0102242 A1 * 4/2017 Breed ..... G01C 21/30
2017/0276489 A1 * 9/2017 Breed ..... G01C 21/30
2018/0299884 A1 * 10/2018 Morita ..... G08G 1/09
2019/0049994 A1 * 2/2019 Pohl ..... G05D 1/0289

* cited by examiner

*Primary Examiner* — Chico A Foxx
(74) *Attorney, Agent, or Firm* — Sheppard, Mullin, Richter & Hampton LLP; Hector A. Agdeppa; Daniel N. Yannuzzi

(57) ABSTRACT

The present disclosure relates to providing vehicles in the real world with instructions while operating on a roadway portion. The roadway portion may be one or more lanes in a segment of a roadway. A first set of vehicles may be equipped with a communication device for communication with one or more servers configured to provide instructions and/or other information. One or more objects at or near the roadway portion may be identified. A presence of first object not in the first set of vehicles may be detected. The first object may not include a communication device. A warning notification may be provided to vehicles at or near the roadway portion when the first object is detected. Instructions to perform one or more driving maneuvers may be provided to vehicles at or near the roadway portion when the first object is detected.

20 Claims, 6 Drawing Sheets

SELF-DRIVING INFRASTRUCTURE

FIELD OF THE DISCLOSURE

The present disclosure relates to facilitating vehicle operation within locations in the real world.

BACKGROUND

Vehicles are required to follow a set of traffic rules while operating on a road. Some vehicles may violate the traffic rules or instructions from authorities. Enforcing the traffic rules on all the roads around the country may be difficult.

SUMMARY

One aspect of the present disclosure relates to providing vehicles in the real world with instructions while operating on a roadway portion. The roadway portion may be one or more lanes in a segment of a roadway. A first set of vehicles may be equipped with a communication device for communication with one or more servers. The servers may be configured to provide instructions and/or other information. The vehicles may be an autonomous vehicle, semi-autonomous vehicle, and/or non-autonomous vehicle. One or more objects at or near the roadway portion may be identified. The objects may be pedestrians, vehicles, and/or other objects. A presence of a first object not in the first set of vehicles may be detected. The presence of the first object not in the first set of vehicles may be detected when the first object cannot be identified and/or may not communicating with the one or more servers. The first object may not include a communication device for communication with the one or more servers. The first object without the communication device may not be able to communicate with the one or more servers. A warning notification may be provided to vehicles at or near the roadway portion when the first object may be detected. Instructions to perform one or more driving maneuvers may be provided to vehicles at or near the roadway portion when the first object may be detected.

In some implementations, a system configured to provide vehicles in the real world with instructions while operating on a roadway may include one or more of one or more servers, one or more vehicles, one or more external resources, and/or other components. In some implementations, the servers may include one or more of electronic storages, one or more physical processors, and/or other components. In some implementations, one or more physical processors may be configured by machine-readable instructions. Executing the machine-readable instructions may cause the one or more physical processors to provide vehicles in the real world with instructions while operating on a roadway. The machine-readable instructions may include one or more computer program components. The one or more computer program components may include one or more of an information component, a detection component, a determination component, an identification component, an effectuation component, and/or other components.

The electronic storages may be configured to store vehicle information and/or other information. The vehicle information may include information for identifying one or more vehicles. The vehicle information may include identifiers that uniquely correspond to individual ones of the vehicles in the first set of vehicles. A vehicle may be identified based on identifiers that uniquely correspond to the vehicle. The identifiers may include one or more of vehicle identification numbers, manufacturer serial number, vehicle registration plate, appearance, and/or other information for identification of vehicles. In some implementations, the vehicle may be identified based on the communication devices in the vehicle. In some implementations, the vehicle information may include information for identifying the one or more communication devices associated with the vehicles. A vehicle may be identified based on the one or more communication devices associated with the vehicle.

The information component may be configured to obtain the vehicle information and/or other information. The information component may be configured to obtain the vehicle information from one or more of the electronic storages, the external resources, and/or other information. In some implementations, the information component may be configured to obtain the vehicle information for identifying the one or more vehicles. In some implementations, the information component may be configured to obtain the vehicle information for identifying the individual ones of the vehicles of the first set of vehicles. In some implementations, the information component may be configured to receive communication from vehicles. The communication from vehicles may include communication from the communication devices associated with the vehicle and/or directly from the vehicles. The communication from the vehicles including vehicle identifications of the vehicles at or near the roadway portion.

The detection component may be configured to obtain presence information and/or other information. The presence information indicating the presences of the objects. The presence information may indicate presences of objects and/or other information. The presence information may indicate presence of the objects at or near the roadway portion. In some implementations, the presence information indicating the presences of the objects may be conveyed by communication between the objects and the server. In some implementations, the presence information indicating the presences of the objects may be conveyed by the output signals of one or more sensors. The detection component may be configured to detect presence of one or more objects based on the presence information. The detection component may be configured to determine the geo-location, motion, identification of the objects, and/or other information based on the presence information.

The determination component may be configured to perform object identification of individual ones of the objects. The determination component may be configured to perform object identification of individual ones of the objects as individual ones of the vehicles in the first set of vehicles. The determination component may be configured to perform object identification of individual ones of the objects at or near the roadway portion. The determination component may be configured to perform object identification of individual ones of the objects based on the locations, the motion, the presence information, vehicle identifications, and/or other information of the object.

The identification component may be configured to detect the presence of objects not in the first set of vehicles at or near the roadway portion. The identification component may be configured to detect the presence of objects at or near the roadway portion not in the first set of vehicles based on the object identification performed, the presence information, and/or other information.

The effectuation component may be configured to determine one or more notifications for the objects at or near the roadway and/or other locations. In some implementations, the effectuation component may be configured determine one or more instructions for the objects at or near the roadway portion. The effectuation component may be configured to determine the one or more notifications, instructions, and/or other information for the objects at or near the roadway portion based on the detection of a first object not in the first set of vehicles. The effectuation component may be configured to provide the vehicles at or near the roadway portion with the notifications, instructions, and/or other information. The effectuation component may be configured to provide the vehicles in the first set of vehicles at or near the roadway portion with the notifications, instructions, and/or other information. The effectuation component may be configured cause the vehicles at or near the roadway portion to effectuate the notification, perform the instructions, and/or take other actions.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description and are not intended as a definition of the limits of the invention. As used in the specification and in the claims, the singular form of "a," "an," and "the" include plural referents unless the context clearly dictates otherwise.

DETAILED DESCRIPTION

Figure 1:
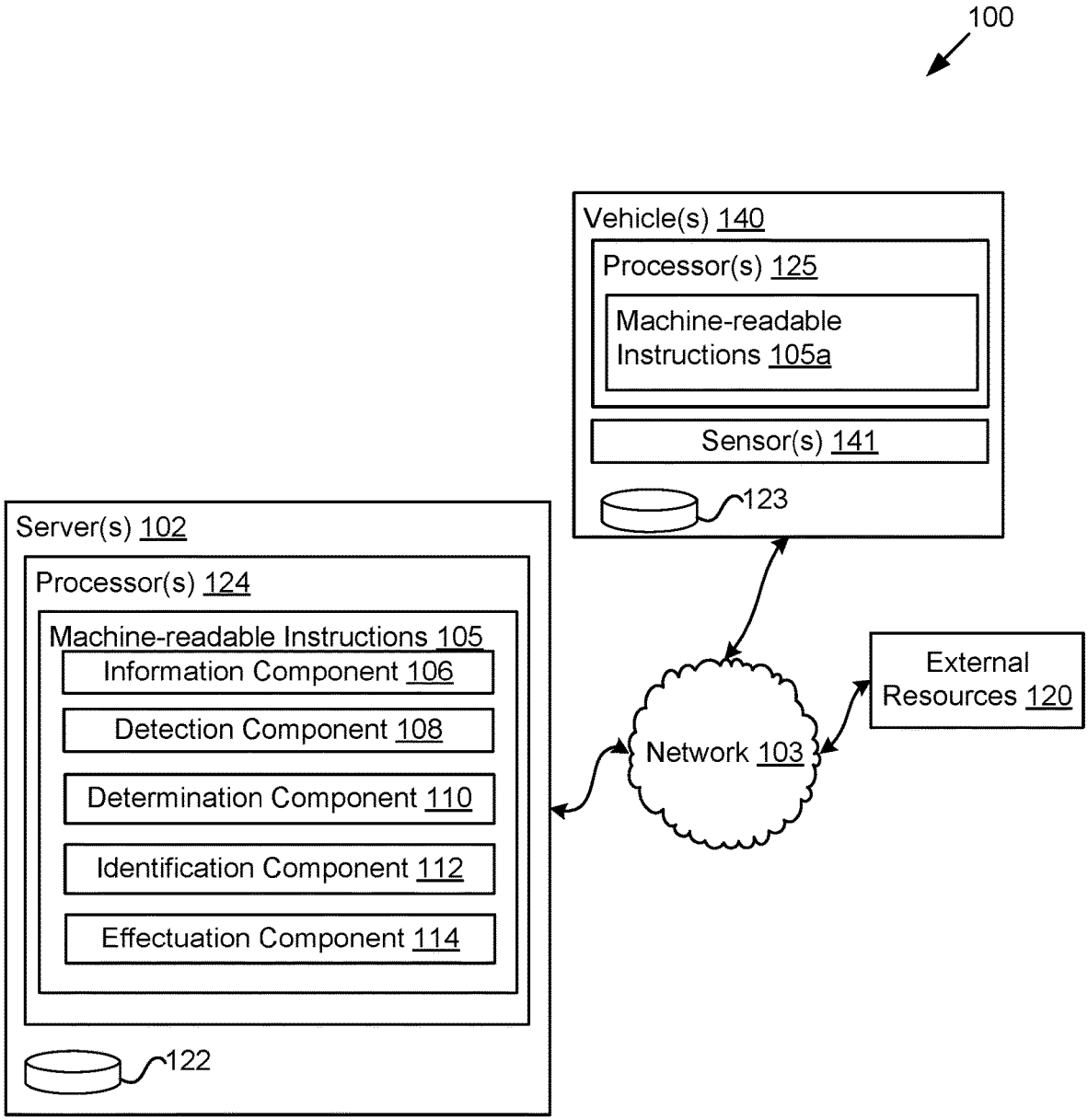
FIG. 1 illustrates a system for facilitating vehicle operations within locations in the real world, in accordance with one or more implementations.

FIG. 1 illustrates a system 100 configured to provide vehicles in the real world with instructions while operating on a roadway. The roadway may be a location in the real world. The roadway may include one or more lanes, sidewalks, and/or other components on a segment of the roadway. The roadway may be a highway, a street, and/or other roadways. The roadway may include one or more real-world objects. The real-world objects may be referred to as objects from here on out. A set of vehicles may be authorized to be in the roadway. A warning may be provided to the vehicles on the roadway when an object in the roadway may not be in the set of vehicles.

In some implementations, system 100 configured to provide vehicles in the real world with instructions while operating on a roadway may include one or more of one or more server(s) 102, one or more vehicle(s) 140, one or more external resources 120, and/or other components. In some implementations, server(s) 102 may include one or more of electronic storages 122, one or more physical processor(s) 124, and/or other components. In some implementations, one or more physical processor(s) 124 may be configured by machine-readable instructions 105. Executing machine-readable instructions 105 may cause one or more physical processors 124 to provide vehicles in the real world with instructions while operating on a roadway. Machine-readable instructions 105 may include one or more computer program components. The one or more computer program components may include one or more of an information component 106, a detection component 108, a determination component 110, an identification component 112, an effectuation component 114, and/or other components.

Vehicle(s) 140 may be one or more of a car, a bus, an airplane, a vessel (such as a ship), a wheelchair, a bicycle, and/or other vehicles. In some implementations, vehicle(s) 140 may be a motorized vehicle. In some implementations, vehicle(s) 140 may include one or more autonomous vehicle, semi-autonomous vehicle, non-autonomous vehicle, and/or other vehicles.

In some implementations, vehicle(s) 140 may include one or more electronic storages 123, one or more physical processors 125, one or more peripherals, one or more sensors, and/or other components. In some implementations, the one or more electronic storages 123 and the one or more physical processor(s) 125 may be the same and/or similar to electronic storages 122, and physical processor(s) 124. Vehicle(s) 140 may include a first vehicle and/or other vehicles. The first vehicle may be associated with a first user. It is noted that vehicle(s) 140 may represent an individual vehicle and/or more than one vehicles that may be similarly configured as described herein.

In some implementations, the one or more peripherals may be removably coupled to vehicle(s) 140 and/or other devices. In some implementations, the one or more peripherals may be integrated in vehicle(s) 140 and/or other devices. The one or more peripherals and/or sensors may be removably and operationally connect to vehicle(s) 140. Connection may be wired and/or wireless. Operational connection may refer to a connection which may facilitate communication of information between vehicle(s) 140 and individual components.

The one or more peripherals may include one or more output devices, input devices, and/or other devices. The output devices may include one or more audio output device, visual output devices, and/or other output devices. The input devices may include one or more of client computing device (such as a smartphone), vehicle control systems, user interfaces, and/or other input devices. The one or more input devices may be configured to obtain user input.

The audio output device may include one or more of speakers, alarms, sirens, headphones, and/or other audio systems configured to generate audible audio signals. The audio output device may be configured to generate output signals conveying audio information. The audio information may include audio signals from the real world, from a user, and/or other locations. The audio output device may include one or more microphones including microelectro-mechanical systems microphones and/or other devices configured to obtain audio signals.

The client computing devices may be mobile devices such as smartphones, personal computers, and/or other devices. The client computing devices may be removably and operationally connect to vehicle(s) 140. Connection may be wired and/or wireless. Operational connection may refer to a connection which may facilitate communication of information between the client computing devices and vehicle(s) 140. In some implementations, the wireless connection may be one or more of a Wi-Fi connection, Bluetooth connection, and/or other wireless connections.

The client computing devices may include one or more displays, one or more of the audio output devices, one or more sensors, one or more input devices, and/or other components. The individual client computing devices may include the first client device, a second client device, and/or other client computing devices. The first client computing device may be associated with a first user, the second client computing device may be associated with a second user, and/or the other client computing devices may be associated with other users.

The displays may be a device configured to effectuate presentation of the virtual content and/or other content. The displays include one or more of a touch-enabled display (e.g., the touchscreen), an LCD display, a LED display, an OLED display, a projector, and/or other displays. In some implementations, the display may be a video projector and/or other devices.

The one or more input devices of the client computing devices may include one or more of a joystick, a sensor, a touch-enabled input device, a keypad, a controller, and/or other input devices. The one or more input devices of the client computing devices may be configured obtain user input. The client computing devices provide vehicle(s) 140 with the user input.

In some implementations, the vehicle control systems for vehicle(s) 140 (such as a car, a bus, a vessel) may include one or more of a steering wheel, pedals, gear stick, gear selector, driving mode selector, and/or other vehicle control systems. In some implementations, the vehicle control systems may include a touch-enabled input device configured to obtain touch-based input from a user. The vehicle control systems may be configured to obtain user inputs for controlling and/or operating vehicle(s) 140.

In some implementations, the vehicle control systems for vehicle(s) 140 (such as an airplane) may include one or more of a joystick, a yoke (such as a control wheel), one or more levers, one or more buttons, one or more switches, a touch-enabled input device, and/or other vehicle control systems. The vehicle control systems may be configured to obtain user inputs for controlling and/or operating vehicle(s) 140.

The user interface may include one or more graphical user interfaces presented on one or more displays. The one or more displays may include a touch-enabled input device. The user interface may be configured to effectuation presentation of visual content including one or more prompts for users to provide user input or options for users to select from via a touch-enabled input device, buttons, switches, nobs, and/or other input devices. The user interface may effectuation presentation of information about vehicle(s) 140, the surrounding environment, and/or other information. The information about vehicle(s) 140 may include information about the operation status of the vehicle, the condition of vehicle(s) 140, operating mode of vehicle(s) 140, and/or other information of vehicle(s) 140. The information about surround environment may be information conveyed by sensors of vehicle(s) 140. A user may provide user input via the user interface to control one or more systems of vehicle(s) 140.

A touch-enabled input device may be a touch screen and/or other devices. The touch screen may include one or more of a resistive touchscreen, a capacitive touchscreen, a surface acoustic wave touchscreen, an infrared touchscreen, an optical imaging touchscreen, an acoustic pulse recognition touchscreen, and/or other touchscreens. The touch-enabled input device may be configured to generate output signals conveying touch gesture information defining touch gesture inputs of the user.

Input devices may be configured to obtain user input and/or other information. In some implementations, the user input may specify instructions for vehicle(s) 140. In some implementations, the user input may specify instructions for the individual client computing devices and/or other devices. The user input may include one or more of a body gesture input, touch gesture input, controller input, text input, audio input, steering input, gear selection input, acceleration input, and/or other inputs.

The body gesture input may include information defining movement of a body part of the user, including movement of a hand, arm, leg, lip, and/or other body parts of the user. In some implementations, the body gesture input may be obtained for visuals of the user. In some implementations, the body gesture input may convey sign language and/or other instructions. The sign language may specify instructions.

The touch gesture input may include information defining one or more movements. The movements may include one or more of a finger press, a finger tap, a finger swipe, a finger flick, a finger drag, a pinch, a touch-and-hold, a scroll, and/or other finger movements. These movements may similarly be carried out using a tool, such as a stylus.

The controller input may include information defining one or more of a key/button pressing input, a key/button tapping input, a swiping input, a flick input, a drag input, a key/button press-and-hold input, a scroll input, and/or other inputs from a controller. The controller input may include one or more of a movement of a mouse, a movement of a mouse while holding a button on the mouse, a press of one or more keys of a keyboard, a movement of a joystick, a movement of a joystick while holding of a button on a controller, and/or other controller inputs.

In some implementations, the text input may be obtained from a keyboard, an audio input device, and/or other devices. The text input may include one or more words in one or more languages. In some implementations, text input may be obtained from one or more voice recognition systems, natural language processing systems, gesture recognition systems, and/or other systems. The voice recognition systems may obtain audio signals from a user conveying one or more words and/or phrases. The natural language processing systems may obtain audio signals from a user and determine one or more words and/or phrases being conveyed by the user. The gesture recognition systems may obtain visual of the user conveying one or more words and/or phrases and/or instructions. The gesture recognition systems may interpret sign language.

The audio input may include audio information defining audio signals of the user. The audio signal of the user may be captured by a microphone and/or other audio capture devices. The audio signals from the user may be a voice command. In some implementations, instructions may be associated with the voice commands. In some implementations, audio input may be obtained from the one or more voice recognition systems, natural language processing systems, and/or other systems.

The steering input may be obtained from a steering wheel and/or other devices of a vehicle. The steering input may be generated by a user when the user turns and/or moves the steering wheel. The steering input may specify a rotation of one or more wheels of a vehicle.

The gear selection input may be obtained from a gear stick and/or gear selector of a vehicle. The gear selection input may be generated by a user when the user engages a gear with the gear stick and/or gear selector of the vehicle.

The acceleration input may be obtained from a pedal of a vehicle. The acceleration input may be generated by a user when the user engages an accelerator or brake of the vehicle.

In some implementations, the one or more sensors of vehicle(s) 140 may include sensor(s) 141 and/or other sensors. Vehicle(s) 140 may include one or more image sensors, depth sensors, infrared sensors, radar, orientation sensors, position sensors, and/or other sensors.

In some implementations, vehicle(s) 140 may include one or more communication devices and/or other devices. The communication devices may be a transponder, the client computing device, and/or other communication devices. The communication devices may be configured to communicate with server(s) 102 and/or other devices. The communication devices may be configured to communicate information of the corresponding vehicle with server(s) 102 and/or other devices. The information of the corresponding vehicle may include identifiers that may uniquely correspond to the vehicle. For example, the identifiers that may uniquely correspond to the vehicle may include one or more of vehicle identification numbers, serial numbers, vehicle registration plate, and/or other identifying information. In some implementations, a communication device may communicate information of the vehicle associated with the communication device. For example, the communication device may communicate the identifiers that may uniquely correspond to the vehicle associated with the communication device. In some implementations, the communication device may be configured to transmit output signals of the one or more sensors.

In some implementations, the one or more sensors may include one or more image sensors, depth sensors, electromagnetic wave sensors, infrared sensors, radar, inductive sensor, and/or other sensors.

In some implementations, the image sensors may be configured to generate output signals conveying visual information and/or other information. The visual information may define visuals within a field of view of the image sensor and/or other content. The visuals may include depictions of the objects and/or surfaces. The visuals may be in the form of one or more of images, videos, and/or other visual information. The real-world objects may include one or more vehicles, people, and/or other objects. The field of view of the image sensors may be a function of a position and an orientation of the image sensors.

In some implementations, an image sensor may comprise one or more of a photosensor array (e.g., an array of photosites), a charge-coupled device sensor, an active pixel sensor, a complementary metal-oxide semiconductor sensor, an N-type metal-oxide-semiconductor sensor, and/or other devices.

In some implementations, the objects may be identified from the visual information. The objects may be identified from the visual information based on the appearance of the objects indicated by the visual information. For example, the individual objects may have an appearance that may or may not uniquely correspond to the objects.

In some implementations, a depth sensor may be configured to generate output signals conveying depth information and/or other information. The depth information may generate a three-dimensional map of a three-dimensional space. The three-dimensional map may be a representation of the three-dimensional space and/or include information of the three-dimensional space. The three-dimensional map may include depictions of the objects in the three-dimensional space. The three-dimensional map may specify the shape of the objects in the three-dimensional space. The depth information may define a set of points (also referred to as a point cloud) that may lie on surfaces of the objects within a field of view and/or range of the depth sensor and/or other content. In some implementations, depth information may specify individual ranges of the individual points within three-dimensional space. The field of view of the depth sensors may be a function of a position and an orientation of the depth sensors.

In some implementations, a depth sensor may comprise of one or more of a depth camera, a time-of-flight sensor, lidar systems, laser scanner, radar scanner, and/or other systems that may be configured to map a real-world environment.

In some implementations, the objects may be identified from the depth information. The objects may be identified from the depth information based on the appearance of the objects indicated by the depth information. For example, the individual objects may have an appearance indicated by the depth information that may or may not uniquely correspond to the objects. The objects may be identified from the depth information based on the shape of the objects indicated by the depth information. For example, the individual objects may have a shape indicated by the depth information that may or may not uniquely correspond to the objects.

In some implementations, an infrared sensor may be configured to generate output signals conveying infrared information and/or other information. The infrared information may define visuals in the infrared spectrums within a field of view of the infrared sensor and/or other content. The visuals in the infrared spectrums may include depictions of the objects and/or surfaces. The visuals in the infrared spectrums may be in the form of one or more of images, videos, and/or other visual information. The objects may include one or more vehicles, people, and/or other objects. The field of view of the infrared sensors may be a function of a position and an orientation of the image sensors. In some implementations, the infrared information may define temperature information of a three-dimensional space. The temperature information of the three-dimensional space may include temperature information of surfaces of the objects within a field of view of the infrared sensor. The field of view of the infrared sensors may be a function of a position and an orientation of the infrared sensors.

In some implementations, the objects may be identified from the infrared information. The objects may be identified from the infrared information based on the temperature of the objects. For example, the objects may be identified based on a heat signature of the objects indicated by the temperature of the real-world objects. The individual objects may have individual heat signatures that may or may not uniquely correspond to the objects. The objects may be identified from the infrared information based on the appearance of the objects. For example, the individual objects may have an individual appearance based on the infrared information that may or may not uniquely correspond to the objects.

In some implementations, an infrared sensor may comprise of one or more infrared cameras, infrared emitters, infrared receivers, thermal infrared sensors, quantum infrared sensors, and/or other sensors and/or devices.

In some implementations, a radar may be configured to generate output signals conveying radio information and/or other information. The radio information may define radio signatures of the objects in the real-world environment. The radio information may define radio signatures within a field of view of the radar and/or other content. The radio signatures may indicate the objects in the real-world environment. The radio signatures may convey information of the objects. For example, the radio signatures may convey a range, angle, velocity, size, and/or other information of the objects. The field of view of the radar may be a function of a position and an orientation of the radar.

In some implementations, the objects may be identified from the radio information. The objects may be identified from the radio information based on the radio signatures of the objects. For example, the individual objects may have individual radio signatures that may or may not uniquely correspond to the objects, and may be identified from the radio signatures of the objects. In some implementations, the objects may be identified from the information conveyed by the radio signatures. For example, the object may be identified by its angle, angle, velocity, size, and/or other information of the objects.

In some implementations, the radar may be one or more of a bistatic radar, continuous-wave radar, Doppler radar, monopoles radar, passive radar, planar array radar, pulse-doppler radar, synthetic aperture radar, over-the-horizon radar, and/or other radar.

In some implementations, an inductive sensor may be configured to generate output signals conveying magnetic flux information. The magnetic flux information may indicate movements of the objects in proximity to the inductive sensor. The objects may be metallic. The magnetic flux information specifies a change in a magnetic field and/or electric current generated by the inductive sensor based on the movements of the objects in proximity to the inductive sensor. The change in the magnetic field and/or electric current generated by the inductive sensor may indicate characteristics of the objects. The magnetic flux information may indicate a range between the and the inductive sensor.

In some implementations, the objects may be identified from the magnetic flux information. The objects may be identified from the change in a magnetic field and/or electric current generated by the inductive sensor. The objects may be identified from the characteristics of the objects indicated by the change in the magnetic field and/or electric current generated by the inductive sensor. For example, the individual objects may have an individual magnetic field and/or electric current that may or may not uniquely correspond to the objects.

In some implementations, the inductive sensor may be one or more of an induction coil, induction loop, coil magnetometer, and/or other inductive sensors. In some implementations, the inductive sensor may be install on a road surface and/or over a road surface.

An orientation sensor may be configured to generate output signals conveying orientation information and/or other information. Orientation information derived from output signals of an orientation sensor may define an orientation. In some implementations, orientation may refer to one or more of a pitch angle, a roll angle, a yaw angle, and/or other measurements. An orientation sensor may include an inertial measurement unit (IMU) such as one or more of an accelerometer, a gyroscope, a magnetometer, and/or other devices.

The position sensor may be configured to generate output signals conveying location information. The location information may specify a real-world location of the position sensor. In some implementations, the position sensor may include one or more of a global positioning system (GPS) and/or other positioning systems. In some implementations, the location information may specify a distance of the position sensor from a real-world location.

Sensors may be located and/or positioned in a real-world environment, vehicle(s) 140, and/or other locations. For example, the one or more image sensors, depth sensors, electromagnetic wave sensors, infrared sensors, radar, inductive sensor, and/or other sensors may be located and/or positioned in a real-world environment and/or other locations. In some implementations, sensors may be located and/or positioned in the infrastructure in the real world. For example, sensors may be located and/or positioned in the infrastructure of a city, town, road, building, and/or other locations in the real world. For example, sensors may be located in and/or positioned on one or more of a traffic control signal, radio tower, transmission towers, utility poles, buildings, road surfaces, sidewalks, closed-circuit television (CCTV) cameras, trees, pay stations, highway barriers, signs, sirens, bus stops, bridges, fire hydrants, phone lines, power lines, network lines, and/or other infrastructure in the real world. The sensors may be located and/or positioned in the infrastructure such that the field of view or range of effectiveness of sensors may capture information of the real-world objects in the real world. In some implementations, the sensor may be located and/or positioned in vehicles.

Electronic storages 122 may be configured to store vehicle information and/or other information. The vehicle information may include information for identifying one or more vehicles. A vehicle may identified based on identifiers that uniquely correspond to the vehicle. The identifiers may include one or more of vehicle identification numbers, manufacturer serial number, vehicle registration plate, appearance, and/or other information for identification of vehicles.

In some implementations, the vehicle may be identified based on the communication devices in the vehicle. In some implementations, the vehicle information may include information for identifying the one or more communication devices associated with the vehicles. The communication devices may be identified based on one or more of a manufacturer serial number of the communication devices, a user account associated with the communication devices, and/or other information associated with the communication devices. A vehicle may be identified based on the one or more communication devices associated with the vehicle.

The individual identifiers of the vehicle may be associated with individual vehicles. The individual identifiers may uniquely correspond to the individual vehicles. The individual identifiers associated with the individual vehicles may be unique to the individual vehicles. An identifier may include a unique set of characters (such as numerical or alphanumerical characters) that correspond to a vehicle. For example, a first vehicle may have identifiers that are unique and distinct from the identifiers of a second vehicle.

The vehicle information may include identifiers that uniquely correspond to individual ones of the vehicles in a given set of vehicles. For example, the vehicle information may include identifiers that uniquely correspond to individual ones of the vehicles in a first set of vehicles.

In some implementations, the first set of vehicles may be vehicles of a fleet of vehicles, vehicles with the same hardware and/or operating systems, vehicles with the same vehicle features, and/or other vehicles. In some implementations, the first set of vehicles may be vehicles authorized and/or given access to operate on a roadway portion. The roadway portion may be a set of one or more lanes on a segment of a roadway.

By way of non-limiting example, a vehicle may be authorized and/or given access to operate on a roadway portion if the vehicle satisfies one or more access criteria. The one or more access criteria include having one or more of a communication device, a given hardware and/or operating systems, a given vehicle feature, a membership or subscription, a valid identification, being a part of a fleet of vehicles, paid a fee, being connected to server(s) 102, and/or other criteria. By way of non-limiting example, a vehicle may be authorized and/or given access to operate on a roadway portion if the vehicle includes a transponder configured to communicate with server(s) 102. Authorization and/or access to a roadway portion may include permission to operate freely on the roadway portion.

In some implementations, the given vehicle feature may be one or more autonomous control systems. By way of non-limiting example, the first set of vehicles may be autonomous vehicles, semi-autonomous vehicles, and/or other vehicles. In some implementations, the first set of vehicles may be vehicles with one or more of a vehicle-to-vehicle communication system, vehicle-to-infrastructure system, and/or other communication systems.

Information component 106 may be configured to obtain the vehicle information and/or other information. Information component 106 may be configured to obtain the vehicle information from one or more of electronic storages 122, external resources 120, and/or other information. In some implementations, information component 106 may be configured to obtain the vehicle information for identifying the one or more vehicles. In some implementations, information component 106 may be configured to obtain the vehicle information for identifying the individual ones of the vehicles of the first set of vehicles.

In some implementations, information component 106 may be configured to obtain communication from vehicles. Information component 106 may be configured to obtain communication from the vehicles at or near the roadway portion. The communication from the vehicles may include vehicle identifications of the vehicles at or near the roadway portion. For example, the communication from the vehicles may include the identifiers corresponding to the vehicles. The identifiers corresponding to the vehicles may include the vehicle identification numbers, manufacturer serial number, vehicle registration plate information, and/or other identification information corresponding to the vehicles. In some implementations, information component 106 may be configured to obtain the vehicle identifications from the vehicles at or near the roadway portion. In some implementations, the communication from the vehicles may include the identification of the communication devices associated with the vehicles. In some implementations, information component 106 may be configured to obtain communication directly from systems of the vehicles, the communication devices associated with the vehicle, and/or communicated devices connected to the vehicles, and/or other components of the vehicles. In some implementations, the communication from the vehicles used for identifying the vehicles may be used to determine whether the vehicles include the vehicles of the first set of vehicles.

Detection component 108 may be configured to obtain presence information and/or other information. Detection component 108 may be configured to obtain the presence information from one or more of electronic storages 122, external resources 120, and/or other information. The presence information may indicate presences of objects and/or other information. The presence information may indicate presences of the objects in the real world. For example, the presence information may indicate the presence of the objects at or near the roadway portion.

In some implementations, the presence information indicating the presences of the objects may be conveyed by the output signals of the one or more sensors. The presence information may indicate presences of the objects within the field of views of the one or more sensors. In some implementations, the presence information may indicate the detection of the presences of the objects within the field of views of the one or more sensors. The one or more sensors may generate output signals conveying the presence of the objects within the field of views of the one or more sensors. The presence information may include information conveyed by the one or more sensors. In some implementations, the presence information may indicate the appearance and/or other information of the objects. For example, the presence information may indicate the presences of the objects based on one or more of a visual appearance, shape, appearance indicated by the depth information, the heat signatures, temperature, the radio signatures, the induced magnetic field and/or electric field, and/or other information of the object conveyed by output signals of the one or more sensors.

Detection component 108 may be configured to detect the presence of one or more objects. Detection component 108 may be configured to detect the presence of the one or more objects at or near the roadway portion. The objects may be one or more of the vehicles, pedestrians, and/or other objects. The objects may be at or near the set of one or more lanes on the segment of the roadway. An object at or near the roadway portion may be on a lane of the segment of the roadway, in proximity to a lane of the segment of the roadway in a given range from a lane of the segment of the roadway, adjacent to a lane of the segment of the roadway, and/or at or near the roadway portion in other ways. Detection component 108 may be configured to detect the presence of one or more objects based on the presence information and/or other information.

Detection component 108 may be configured to detect the presence of the one or more objects based on the output signals of the one or more sensors. Detection component 108 may be configured to detect the presence of the one or more objects based on the presence of the objects within the field of view of the one or more sensors. Detection component 108 may be configured to detect the presence of one or more objects based on presence information and/or other information. In some implementations, the presence information may be used for determining geo-location, motion, identification of the objects, and/or other information.

In some implementations, the presence information may be determined by detection component 108 based the information received from the objects. The reception of information from the objects may indicate the presence of the object. In some implementations, the presence information may be determined by detection component 108 based the information received from the communication devices of the vehicles and/or directly from the vehicles. For example, the reception of information from the communication devices of the vehicles and/or directly from the vehicles may indicate the presence of the vehicle. For example, detection component 108 may obtain transmission from a pedestrian's mobile device. The pedestrian's mobile phone transmission may indicate the presence of the pedestrian at or near the roadway portion.

In some implementations, the presence information may be determined by detection component 108 based the output signals of the one or more sensors. In some implementations, the presence information may be determined by detection component 108 based the information conveyed by the output signals of the one or more sensors.

In some implementations, the presence information received may include identifiers of the objects at or near the roadway portion. For example, the presence information may include identifiers of the vehicles at or near the roadway portion, including the vehicle identification numbers, the manufacturer serial number, the vehicle registration plate, and/or other identifications from the vehicles. For example, the presence information may include identification information from pedestrians at or near the roadway portion. The identification information from pedestrians may include an identification of the mobile device of the user, user identification, user account, and/or other identification information.

In some implementations, the identification of the object may be determined based on the output signals of the one or more sensors. For example, the appearance of the object may be used to determine the identification of the object. In some implementations, the identifiers one the vehicles may be determined based on the output signals of the one or more sensors. For example, the appearance of the vehicle may be used to determine identifiers associated with the vehicle. For example, the appearance of the vehicle may be used to determine the vehicle registration plate on the vehicle. The presence information may indicate the location of the objects within the field of view of the sensors, the distance of the objects from the sensors, a range of the object from the sensors, and/or other information of the object in relation to the sensors.

In some implementations, detection component 108 may be configured may be configured to determine the geo-location of the objects by triangulating the position of the objects based on the signal strength of the transmissions of the objects. For example, detection component 108 may be configured may be configured to determine the geo-location of the vehicle by triangulating the position of the vehicle based on the signal strength of the transmissions of the communication devices and/or the vehicle.

In some implementations, detection component 108 may be configured may be configured to determine the geo-location of the objects based on the output signals of the one or more sensors. For example, detection component 108 may be configured to determine the geo-location of the objects based on the objects within the field of view of the one or more sensors. In some implementations, detection component 108 may be configured determine the geo-location of the objects in the real world by triangulating the position of the objects in the real world based on the presence information and/or other information. In some implementations, detection component 108 may be configured to determine the geo-location of the objects in the real world by triangulating the position of the objects in the real world from the position of the object within the field of view of the one or more sensors indicating the presence of the object. In some implementations, detection component 108 may be configured to determine the geo-location of the objects in the real world by triangulating the position of the objects in the real world from a distance between the objects and the one or more sensors. In some implementations, detection component 108 may be configured to determine the geo-location of the objects by determining a distance between the objects and one or more reference locations in the real world. The objects and the reference location in the real world may be within the field of view of the one or more sensors. The reference locations may include one or more of a landmark, building, infrastructure, and/or other reference locations.

In some implementations, detection component 108 may be configured may be configured to determine the geo-location of the objects based on the positioned information conveyed by the position sensor of the objects. For example, the vehicle may be configured to generate position information conveying the geo-location of the vehicle based on a position sensor (such as a GPS) of the vehicle. For example, the pedestrian may be configured to generate position information conveying the geo-location of the vehicle based on a position sensor (such as a GPS) associated with the pedestrian. In some implementations, the positioned information conveyed by the position sensor of the objects may be received from the communication devices and/or the vehicles. In some implementations, detection component 108 may be configured obtain the positioned information conveyed by the position sensor of the objects. In some implementations, detection component 108 may be configured obtain the positioned information from a transmission from the communication device of the vehicles.

Detection component 108 may be configured to determine the motion of the objects in the real world based on the presence information and/or other information. Detection component 108 may be configured to determine the motion of the objects at or near the roadway portion. Detection component 108 may be configured to determine the motion of the vehicles, the pedestrians, and/or other objects based on the presence information and/or other information. In some implementations, detection component 108 may be configured to determine the motion of the objects from the objects' locations at one or more points in time. Detection component 108 may be configured to determine the motion of the objects from the objects' change in location over time.

In some implementations, detection component 108 may be configured to determine the motion of the objects in the real world based on the one or more lanes on the segment of the roadway the objects may be located. For example, individual lanes may be configured for vehicles to move in a single direction, and a vehicle on the individual lanes may be traveling in the direction associated with the individual lanes. In some implementations, detection component 108 may be configured to determine the motion of the objects in the real world based on the previous trajectory of the objects in the real world.

In some implementations, detection component 108 may be configured to predict the motion of the objects in the real world based on the previous trajectory of the objects in the real world. For example, detection component 108 may be configured to predict the motion of the objects while traveling on the one or more lanes on the segment of the roadway the objects may be located.

Determination component 110 may be configured to perform object identification of individual ones of the objects. Determination component 110 may be configured to perform object identification of individual ones of the objects at or near the roadway portion. Determination component 110 may be configured to perform object identification of individual ones of the objects based on the locations, the motion, and/or other information of the object. Determination component 110 may be configured to perform object identification of individual ones of the objects based on the locations, the motion, the vehicle identifications, and/or other information of the object.

In some implementations, determination component 110 may correlate the location and motion of the objects to identify the object. For example, determination component 110 may identify the object as a vehicle when the object may be at a lane on a roadway and moving along the lane, or the object as a pedestrian when the object may be at a sidewalk and moving along the sidewalk.

In some implementations, determination component 110 may be configured to identify the objects based on a velocity and/or acceleration of the object. The velocity and/or acceleration of the object may be determined from the locations and/or motion of the objects. For example, an object moving at a velocity and/or acceleration only achievable by a vehicle may be identified as a vehicle, an object moving with average velocity and/or acceleration similar to a pedestrian may be identified as a pedestrian. Other methods for identifying an object based on velocity and/or acceleration may be contemplated.

In some implementations, determination component 110 may identify the objects based on the vehicle identifications received from the vehicles and/or other identifications from the objects. The vehicle identifications received may include identifiers for identifying the vehicles. By way of non-limiting example, the vehicle identifications received from the vehicles may be transmitted by the communication devices of the vehicle. In some implementations, determination component 110 may identify the objects based on the identifications received from the pedestrians.

In some implementations, determination component 110 may be configured to identify the objects such as vehicles based on the communication devices on the vehicles. For example, a vehicle with the communication device may be identified based on the communication device on the vehicle. For example, the communication device to uniquely correspond to the vehicle or be associated with the vehicle at a given point in time, and the transmission information identifying the communication device from the communication device may indicate the identity of the vehicle.

In some implementations, determination component 110 may be configured to identify the real-world objects based on the locations and/or motion of the objects. In some implementations, determination component 110 may be configured to use one or more machine learning techniques to identify the objects based on the locations and/or motion of the objects. In some implementations, determination component 110 may correlate the location and motion of the objects to identify the object. For example, determination component 110 may identify the object as a vehicle when the object may be at a lane on a roadway and moving along the lane, or the object as a pedestrian when the object may be at a sidewalk and moving along the sidewalk.

In some implementations, determination component 110 may be configured to identify individual ones of the objects based on the appearance of the objects conveyed by the output signals of the one or more sensors. Determination component 110 may be configured to identify the objects based on the appearance of the objects using one or more computer vision techniques, image classification techniques, machine-learning techniques, and/or other techniques. For example, determination component 110 may be configured to obtain information conveying the appearance of the objects, and classify the image using one or more image classification techniques to identify the object. The appearance of the objects may be conveyed by output signals of the one or more sensors such as an image sensor and/or other sensors. In some implementations, the appearance of the objects may be conveyed by the presence information and/or other information.

Determination component 110 may be configured to perform object identification of individual ones of the objects as individual ones of the vehicles in the first set of vehicles. Determination component 110 may be configured to perform object identification of individual ones of the objects as individual ones of the vehicles in the first set of vehicles based on the locations, the motion, the vehicle identifications, and/or other information of the object. Determination component 110 may be configured to perform object identification of individual ones of the objects to determine whether the objects are in the first set of vehicles. Determination component 110 may determine whether the objects are in the first set of vehicles from the identifiers of the vehicles.

Identification component 112 may be configured to detect the presence of objects not in the first set of vehicles at or near the roadway portion. Identification component 112 may be configured to detect the presence of objects at or near the roadway portion not in the first set of vehicles based on the presence information, the vehicle identifications, the vehicle information, and/or other information. Identification component 112 may be configured to detect the presence of objects at or near the roadway portion not in the first set of vehicles based on the object identification performed, the presence information, and/or other information. Identification component 112 may be configured to detect the presence of objects at or near the roadway portion not in the first set of vehicles by comparing the vehicle identification performed with the vehicle information. For example, identification component 112 may compare the identifiers of the vehicles on the roadway portion with the identifiers of the vehicles in the first set of vehicles, and responsive to the identifiers not matching, identification component 112 may be configured to determine that the objects at or near the roadway portion may not be in the first set of vehicles.

In some implementations, identification component 112 may be configured to determine that the objects at or near the roadway portion may not be in the first set of vehicles if the objects cannot be identified. In some implementations, identification component 112 determine that the objects at or near the roadway portion may not be in the first set of vehicles if the objects do not include the communication devices. In some implementations, identification component 112 may be configured to determine that the objects at or near the roadway portion may not be in the first set of vehicles if the information was not received from the communication devices of the object. In some implementations, identification component 112 may be configured to determine that the objects at or near the roadway portion may not be in the first set of vehicles if the information of the identifiers received from the communication devices of the vehicles does not match the identifiers of the first set of vehicles. For example, identification component 112 may be configured to determine a first object at or near the roadway portion may not be in the first set of vehicles.

Effectuation component 114 may be configured determine one or more notifications for the objects at or near the roadway and/or other locations. Effectuation component 114 may be configured determine one or more vehicle notifications for the vehicles at or near the roadway and/or other locations. Effectuation component 114 may be configured determine one or more vehicle notifications based on the objects at or near the roadway and/or other information. Effectuation component 114 may be configured determine one or more vehicle notifications based on the location, the motion, the identification, and/or other information of the objects at or near the roadway. The vehicle notifications may include one or more default notifications, warning notifications, and/or other notifications.

In some implementations, effectuation component 114 may be configured determine a default notification when the objects at or near the roadway portion. In some implementations, effectuation component 114 may be configured determine the default notification when the objects at or near the roadway are vehicles of the first set of vehicles. The default vehicle notification may indicate that the roadway may be safe for the vehicles of the first set of vehicles to operate at or near the roadway. By way of non-limiting example, the default notification may include a message notifying that the roadway does not include potentially dangerous objects and/or situations.

In some implementations, effectuation component 114 may be configured determine a warning notification when the first object at or near the roadway portion may be detected. For example, the warning notification may be a message of caution for the first object at or near the roadway. The warning notification may be a warning to vehicles at or near the roadway portion.

In some implementations, the warning notification may be based on the motion of the first object at or near the roadway portion. For example, the warning notification may notify the vehicles of the intended trajectory of the first object at or near the roadway portion. The warning notification may notify the vehicles at or near the roadway portion of a potentially dangerous situation, the potentially dangerous situation being the first object at or near the roadway portion. In some implementations, the warning notification may notify the vehicles at or near the roadway portion of the first object may be at or near the roadway portion. In some implementations, the warning notification may notify the vehicles at or near the roadway portion to avoid the one or more lanes on the segment of the roadway with the first object. In some implementations, the warning notification may notify the users to be vehicle to be tentative and/or cautious in the operation of the vehicle. In some implementations, the warning notification may notify the users to take control of the vehicle.

In some implementations, effectuation component 114 may be configured determine one or more instructions for the objects at or near the roadway portion. Effectuation component 114 may be configured determine one or more vehicle instructions for the vehicles at or near the roadway and/or other locations. Effectuation component 114 may be configured determine one or more vehicle instructions based on the objects at or near the roadway and/or other information. Effectuation component 114 may be configured determine one or more vehicle instructions based on the location, the motion, the identification, and/or other information of the objects at or near the roadway. The vehicles instructions may include instructions for the vehicle to perform one or more driving maneuvers. The vehicles instructions may include instructions for the vehicle to perform one or more driving maneuvers to avoid the potentially dangerous situation, the first object, and/or other driving maneuvers. The driving maneuvers may include reducing speed, stopping, changing lanes on the roadway, and/or other driving maneuvers. In some implementations, the one or more vehicle instructions may include disabling autonomous and or semi-autonomous features on the vehicle and requesting manual control from the user of the vehicle. In some implementations, the one or more vehicle instructions may include abandoning one or more predetermined routes of the vehicles and/or taking new routes on the roadway. In some implementations, the one or more vehicle instructions may include abandoning one or more predetermined driving maneuvers for the vehicles to perform. For example, the one or more vehicle instructions may include abandoning one or more lane changes, merging, exiting, turning, and/or other driving maneuvers for the vehicles to perform.

Effectuation component 114 may be configured to provide objects at or near the roadway portion with the notifications, instructions, and/or other information. Effectuation component 114 may be configured to provide the vehicles at or near the roadway portion with the notifications, instructions, and/or other information. Effectuation component 114 may be configured to provide the vehicles in the first set of vehicles at or near the roadway portion with the notifications, instructions, and/or other information. In some implementations, effectuation component 114 may be configured to provide an authority and/or an administrator of the roadway with the notifications. In some implementations, effectuation component 114 may be configured to provide the authority and/or the administrator of the roadway with a notification of the first object's presence at or near the roadway portion. The authority and/or the administrator may be a law enforcement authority.

In some implementations, effectuation component 114 may be configured to provide objects with the instructions and cause the objects to carry out the instructions. For example, effectuation component 114 may provide the vehicles with instructions to perform the one or more driving maneuvers and cause the vehicles to perform the one or more driving maneuvers. Effectuation component 114 may cause the vehicles of the first set of vehicles to perform the one or more driving maneuvers and/or other actions.

In some implementations, effectuation component 114 may be configured to provide the vehicles with the communication devices with the notifications, instructions, and/or other information. Effectuation component 114 may cause the vehicles with the communication devices the one or more driving maneuvers and/or other actions. By way of non-limiting example, the instructions to perform the one or more driving maneuvers may include driving maneuvers to escort, monitor, and/or remove the first object from the roadway portion. Effectuation component 114 may be configured cause the vehicles at or near the roadway portion to effectuate the notification, perform the instructions, and/or take other actions. The notification may be effectuated on a display of the vehicle. The notifications may include audio and/or visual content.

In some implementations, effectuation component 114 may be configured to determine the notification, the instructions, and/or other information responsive to a detection of the first object in the roadway portion that is not in the first set of vehicles.

In some implementations, effectuation component 114 may be configured provide the notification, the instructions, and/or other information responsive to the detection of the first object in the roadway portion that is not in the first set of vehicles. In some implementations, effectuation component 114 may be configured cause the vehicles at or near the roadway portion to effectuate the notification, perform the instructions, and/or take other actions responsive to the detection of the first object in the roadway portion that is not in the first set of vehicles.

In some implementations, server(s) 102, external resource(s) 120, vehicle(s) 140, and/or other components of system 100 may be operatively linked via one or more electronic communication links. For example, such electronic communication links may be established, at least in part, via a network 103 such as the Internet and/or other networks. It will be appreciated that this is not intended to be limiting, and that the scope of this disclosure may include implementations in which server(s) 102, external resource(s) 120, vehicle(s) 140, and/or other components of system 100 may be operatively linked via some other communication media.

In some implementations, external resource(s) 120 may include sources of information, hosts and/or providers of virtual environments outside of system 100, external entities participating with system 100, and/or other resources. In some implementations, some or all of the functionality attributed herein to external resource(s) 120 may be provided by resources included in system 100.

In some implementations, Server(s) 102 may include electronic storage(s) 122, processor(s) 124, and/or other components. Server(s) 102 may include communication lines or ports to enable the exchange of information with a network and/or other computing devices. Illustration of server(s) 102 in FIG. 1 is not intended to be limiting. Server(s) 102 may include a plurality of hardware, software, and/or firmware components operating together to provide the functionality attributed herein to server(s) 102. For example, server(s) 102 may be implemented by a cloud of computing devices operating together as server(s) 102.

In some implementations, electronic storage(s) 122 may include electronic storage media that electronically stores information. The electronic storage media of electronic storage(s) 122 may include one or both of system storage that is provided integrally (i.e., substantially nonremovable) with server(s) 102 and/or removable storage that is removably connectable to server(s) 102 via, for example, a port (e.g., a USB port, a firewire port, etc.) or a drive (e.g., a disk drive, etc.). Electronic storage(s) 122 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storage(s) 122 may include one or more virtual storage resources (e.g., cloud storage, a virtual private network, and/or other virtual storage resources). Electronic storage(s) 122 may store software algorithms, information determined by processor(s) 124, information received from server(s) 102, information received from vehicle(s) 140, and/or other information that enables server(s) 102 to function as described herein.

In some implementations, processor(s) 124 may be configured to provide information processing capabilities in server(s) 102. As such, processor(s) 124 may include one or more of a digital processor, an analog processor, a digital circuit designed to process information, an analog circuit designed to process information, a state machine, and/or other mechanisms for electronically processing information. Although processor(s) 124 is shown in FIG. 1 as a single entity, this is for illustrative purposes only. In some implementations, processor(s) 124 may include a plurality of processing units. These processing units may be physically located within the same computing platform, or processor(s) 124 may represent processing functionality of a plurality of devices operating in coordination. The processor(s) 124 may be configured to execute computer-readable instruction components 106, 108, 110, 112, 114, and/or other components. The processor(s) 124 may be configured to execute components 106, 108, 110,112, 114, and/or other components by software; hardware; firmware; some combination of software, hardware, and/or firmware; and/or other mechanisms for configuring processing capabilities on processor(s) 124.

It should be appreciated that although components 106, 108, 110, 112, and 114 are illustrated in FIG. 1 as being co-located within a single processing unit, in implementations in which processor(s) 124 may include multiple processing units, one or more of components 106, 108, 110, 112, 114, and/or 116 may be located remotely from the other components. The description of the functionality provided by the different components 106, 108, 110, 112, and/or 114 described herein is for illustrative purposes, and is not intended to be limiting, as any of components 106, 108, 110, 112, and/or 114 may provide more or less functionality than is described. For example, one or more of components 106, 108, 110, 112, and/or 114 may be eliminated, and some or all of its functionality may be provided by other ones of components 106, 108, 110, 112, and/or 114. As another example, processor(s) 124 may be configured to execute one or more additional components that may perform some or all of the functionality attributed herein to one of components 106, 108, 110, 112, and/or 114.

Figure 2:
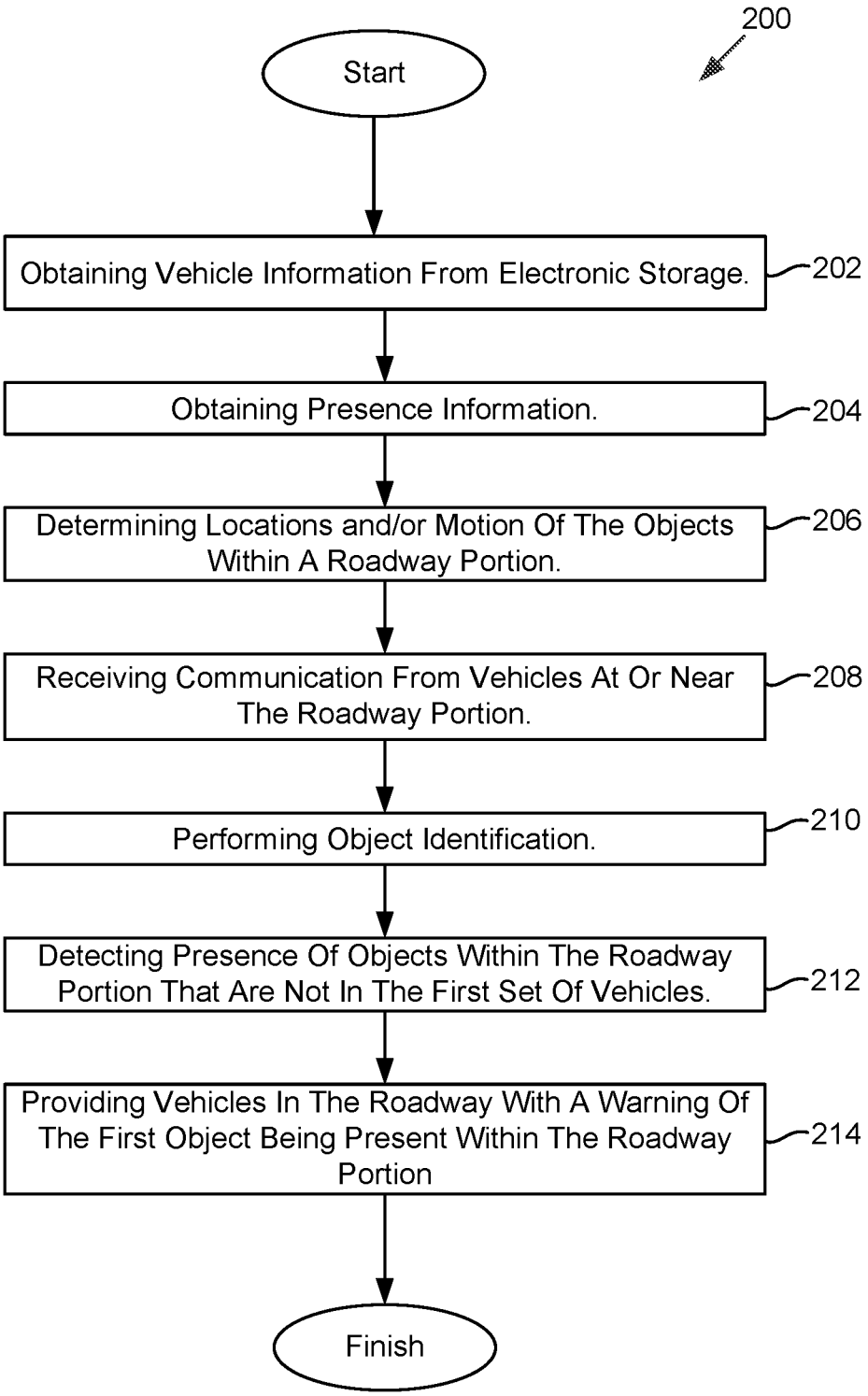
FIG. 2 illustrates a method for facilitating vehicle operations within locations in the real world, in accordance with one or more implementations.

FIG. 2 illustrates a method 200 for providing a group performance using a set of client devices. The operations of method 200 presented below are intended to be illustrative. In some implementations, method 200 may be accomplished with one or more additional operations not described, and/or without one or more of the operations discussed. Additionally, the order in which the operations of method 200 are illustrated in FIG. 2 and described below are not intended to be limiting.

In some implementations, method 200 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 200 in response to instructions stored electronically on an electronic storage medium. The one or more processing devices may include one or more devices configured through hardware, firmware, and/or software to be specifically designed for execution of one or more of the operations of method 200.

At an operation 202, vehicle information may be obtained from electronic storage. The vehicle information including identifiers that uniquely correspond to individual ones of the vehicles in a first set of vehicles. In some embodiments, operation 202 is performed by an information component the same as or similar to information component 106 (shown in FIG. 1 and described herein).

At an operation 204, presence information may be obtained. The presence information indicating the presence of objects within a roadway portion. The roadway portion being a set of one or more lanes on a segment of the roadway. In some embodiments, operation 204 is performed by a detection component the same as or similar to detection component 108 (shown in FIG. 1 and described herein).

At an operation 206, locations and/or motion of the objects within the roadway portion may be determined. The locations and/or motion of the objects within the roadway portion may be determined based on the presence information and/or other information. In some embodiments, operation 206 is performed by the detection component the same as or similar to detection component 108 (shown in FIG. 1 and described herein).

At an operation 208, communication from vehicles at or near the roadway portion may be received. The communication from the vehicles including vehicle identifications of the vehicles at or near the roadway portion. In some embodiments, operation 208 is performed by the information component the same as or similar to information component 106 (shown in FIG. 1 and described herein).

At an operation 210, object identification may be performed. The object identification includes identification of individual ones of the objects as individual ones of the vehicles in the first set of vehicles. The individual ones of the objects as individual ones of the vehicles in the first set of vehicles may be based on the determination of the locations and/or motion of objects and the vehicle identifications received from the vehicles at or near the roadway portion. In some embodiments, operation 210 is performed by an identification component the same as or similar to identification component 112 (shown in FIG. 1 and described herein).

At an operation 212, the presence of objects within the roadway portion that are not in the first set of vehicles may be detected. The presence of objects within the roadway portion that are not in the first set of vehicles may be detected may be based on the performed object identification and the presence information. In some embodiments, operation 212 is performed by a determination component the same as or similar to determination component 110 (shown in FIG. 1 and described herein).

At an operation 214, a warning of the first object being present within the roadway portion may be provided to vehicles in the roadway. The warning of the first object being present within the roadway portion may be provided to vehicles in the roadway responsive to a detection of a first object in the roadway portion that is not in the first set of vehicles. In some embodiments, operation 214 is performed by an effectuation component the same as or similar to effectuation component 114 (shown in FIG. 1 and described herein).

Figure 3:
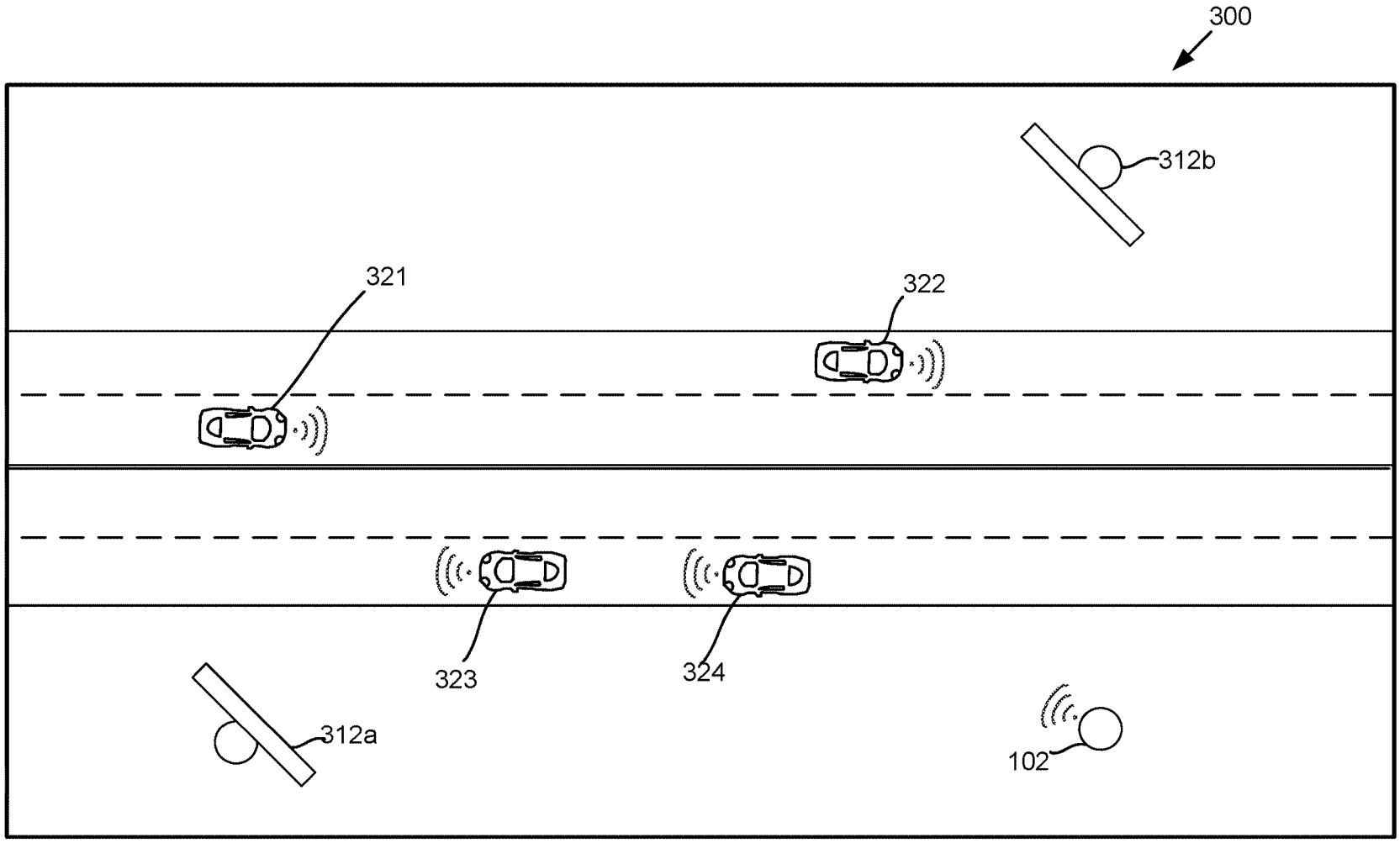
FIG. 3 illustrates one or more objects at or near a roadway portion, in accordance with one or more implementations.

FIG. 3 illustrates one or more objects at or near a roadway portion 300. Roadway portion 300 may include one or more infrastructure structures, vehicles, and/or other devices. The infrastructure structures may include a first structure 312*a*, a second structure 312*b*, and/or other structures. The infrastructure structures may include one or more sensors. The one or more sensors may detect the presence of the objects at or near roadway portion 300. The vehicles may include the first set of vehicles. The first set of vehicles may include a first vehicle 321, a second vehicle 322, a third vehicle 323, a fourth vehicle 324, and/or other vehicles. The first set of vehicles may include the communication devices such as a transponder and/or a client computing device. The communication devices of the first set of vehicles may communicate with server(s) 102. The first set of vehicles have authorization and/or access to roadway portion 300.

Figure 4:
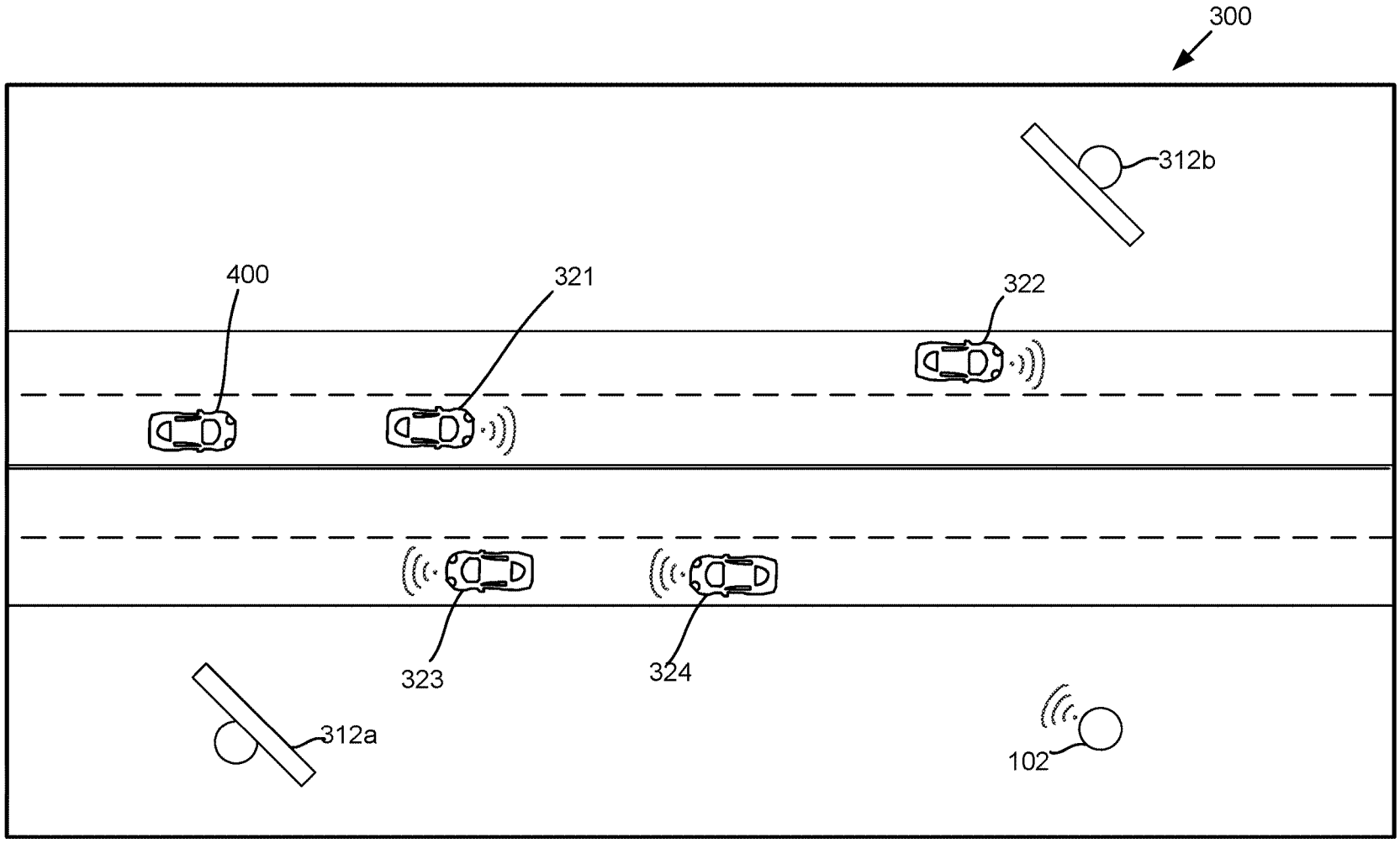
FIG. 4 illustrates a first object not in a first set of vehicles at or near the roadway portion, in accordance with one or more implementations.

FIG. 4 illustrates a first object 400 not in the first set of vehicles at or near roadway portion 300. First object 400 may be a vehicle and/or other objects. First object 400 may not include the communication devices. First object 400 may not be able to communicate with server(s) 102. First object 400 may not be identifiable by the one or more sensors and/or server(s) 102.

Figure 5:
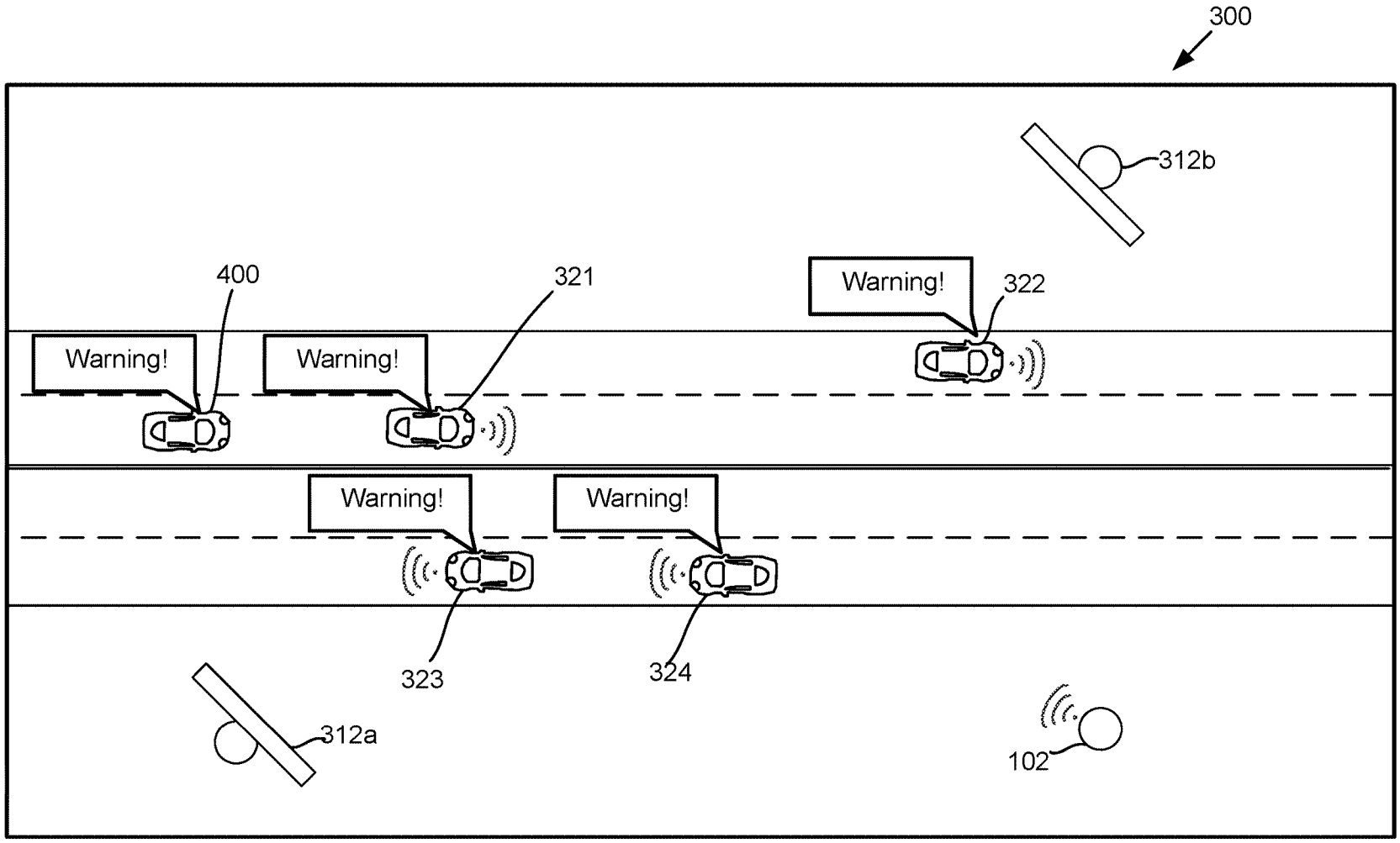
FIG. 5 illustrates the vehicles at or near the roadway portion being provided with a warning responsive to the detection of the first object, in accordance with one or more implementations.

FIG. 5 illustrates the vehicles at or near roadway portion 300 being provided with a warning. The vehicles at or near roadway portion 300 being provided with a warning responsive to the detection of first object 400. The first vehicle 321, second vehicle 322, third vehicle 323, fourth vehicle 324, first object 400, and/or other objects or near roadway portion 300 may be provided with the warning. In some implementations, only the vehicles on the first set of vehicles or the first object 400 may be provided with the warning.

Figure 6:
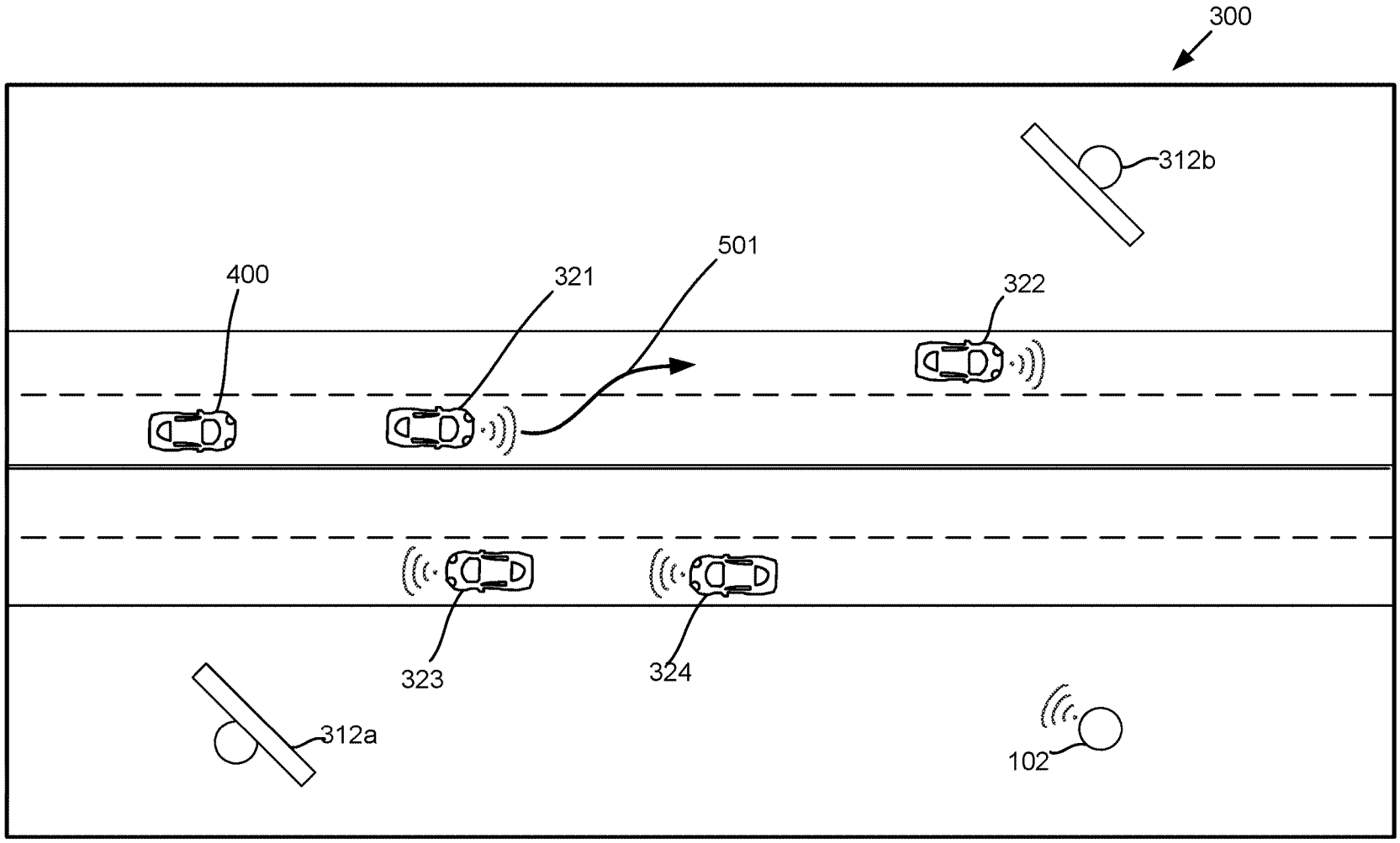
FIG. 6 illustrates the vehicles at or near the roadway portion being provided with instructions responsive to the detection of the first object, in accordance with one or more implementations.

FIG. 6 illustrates a vehicle at or near the roadway portion being provided with instructions responsive to the detection of first object 400. First vehicle 321 may be provided with instructions to perform the one or more driving maneuvers responsive to the detection of first object 400. For example, first vehicle 321 may be provided with instructions to perform a first driving maneuver 501 responsive to the detection of first object 400. First driving maneuver 501 may be to avoid a lane first object 400 may be located in.

Although the system(s) and/or method(s) of this disclosure have been described in detail for the purpose of illustration based on what is currently considered to be the most practical and/or preferred implementations, it is to be understood that such detail is solely for that purpose and/or that the disclosure is not limited to the disclosed implementations, but, on the contrary, is intended to cover modifications and/or equivalent arrangements that are within the spirit and/or scope of the appended claims. For example, it is to be understood that the present disclosure contemplates that, to the extent possible, one or more features of any implementation can be combined with one or more features of any other implementation.

What is claimed:

1. A system configured to provide vehicles in a real world with instructions while operating on a roadway, the system comprising:

electronic storage configured to store vehicle information of a first vehicle, the vehicle information including vehicle identifiers that uniquely correspond to the first vehicle; and a subject vehicle in a first set of vehicles in a determined geo-location comprising a physical processor configured by machine-readable instructions to:

obtain presence information about the first vehicle, the presence information indicating presence of the first vehicle within a determined distance of the subject vehicle;

determine, based on the presence information, a location of the first vehicle;

receive communication from the first vehicle, the communication from the first vehicle including the vehicle information of the first vehicle;

perform vehicle identification of the first vehicle based on the vehicle identifiers received from the first vehicle in the vehicle information;

determine, based on the vehicle identification of the first vehicle and the presence information, whether the first vehicle is a vehicle of the first set of vehicles; and if the first vehicle is not the vehicle of the first set of vehicles and if the first vehicle is within the determined geo-location, generate a warning message indicating that the first vehicle is an unauthorized vehicle because the first vehicle is present within the determined geo-location and is not a member of the first set of vehicles.

2. The system of claim 1, wherein the presence of the first vehicle is detected by one or more sensors.

3. The system of claim 2, wherein the one or more sensors are located on one or more vehicles and/or the determined geo-location, the determined geo-location being a set of one or more lanes on a segment of the roadway.

4. The system of claim 1, wherein the first set of vehicles include one or more vehicles and/or pedestrians.

5. The system of claim 1, wherein responsive to detection of the first vehicle that is not in the first set-of vehicles and the first vehicle is within the determined geo-location, the physical processor is configured by machine-readable instructions to:

provide the first vehicle with instructions for performing one or more driving maneuvers.

6. The system of claim 5, wherein the one or more driving maneuvers may be including reducing speed, stopping, and/or changing lanes.

7. The system of claim 1, wherein responsive to detection of the first vehicle that is not in the first set-of vehicles and the first vehicle is within the determined geo-location, the physical processor is configured by machine-readable instructions to:

provide law enforcement authority with a notification of the first vehicle's presence-in the determined geo-location.

8. The system of claim 1, wherein the first set of vehicles have authorization to be in the determined geo-location.

9. The system of claim 8, wherein authorized vehicles satisfy one or more access criteria comprising:

a given communication device, a given hardware and/or operating system, a given vehicle feature, a membership or subscription, a valid identification, being a part of a fleet of vehicles, paid a fee, and being connected to a remote server.

10. The system of claim 1, wherein the warning message includes an audio and/or visual warning.

11. A method configured to provide vehicles in a real world with instructions while operating on a roadway, the method comprising:

storing vehicle information of a first vehicle in electronic storage, the vehicle information including vehicle identifiers that uniquely correspond to the first vehicle; and a subject vehicle in a first set of vehicles in a determined geo-location comprising a physical processor configured by machine-readable instructions for:

obtaining presence information about the first vehicle, the presence information indicating presence of the first vehicle, within a determined distance of the subject vehicle;

determining, based on the presence information, a location of the first vehicle;

receiving communication from the first vehicle, the communication from the first vehicle including the vehicle information of the first vehicle;

performing vehicle identification of the first vehicle based on the vehicle identifiers received from the first vehicle in the vehicle information;

determining, based on the vehicle identification of the first vehicle and the presence information, whether the first vehicle is a vehicle of the first set of vehicles; and if the first vehicle is not the vehicle of the first set of vehicles and if the first vehicle is within the determined geo-location, generating a warning message indicating that the first vehicle is an unauthorized vehicle because the first vehicle is present within the determined geo-location and is not a member of the first set of vehicles.

12. The method of claim 11, wherein the presence of the first vehicle is detected by one or more sensors.

13. The method of claim 12, wherein the one or more sensors are located on one or more vehicles and/or the determined geo-location, the determined geo-location being a set of one or more lanes on a segment of the roadway.

14. The method of claim 11, wherein the first set of vehicles include one or more vehicles and/or pedestrians.

15. The method of claim 11, wherein responsive to detection of the first vehicle that is not in the first set-of vehicles and the first vehicle is within the determined geo-location, the method further comprises of:

providing the first vehicle with instructions for performing one or more driving maneuvers.

16. The method of claim 15, wherein the one or more driving maneuvers may be including reducing speed, stopping, and/or changing lanes.

17. The method of claim 11, wherein responsive to detection of the first vehicle that is not in the first set-of vehicles and the first vehicle is within the determined geo-location, the method further comprises of:

providing law enforcement authority with a notification of the first vehicle's presence-in the determined geo-location.

18. The method of claim 11, wherein the first set of vehicles have authorization to be in the determined geo-location.

19. The method of claim 18, wherein authorized vehicles satisfy one or more access criteria comprising:

a given communication device, a given hardware and/or operating system, a given vehicle feature, a membership or subscription, a valid identification, being a part of a fleet of vehicles, paid a fee, and being connected to a remote server.

20. The method of claim 11, wherein the warning message includes an audio and/or visual warning.

* * * * *